United States Patent [19]

Evans et al.

[11] 3,972,462

[45] Aug. 3, 1976

[54] SHINGLE LAYING MACHINE AND PROCESS

[75] Inventors: Brad D. Evans, Englewood; Charles E. Werner, Denver; James S. Andrews, Westminster, all of Colo.

[73] Assignees: Brad D. Evans, Englewood; Charles E. Werner, Denver, both of Colo.

[22] Filed: Mar. 28, 1975

[21] Appl. No.: 563,183

[52] U.S. Cl. ..... 227/111

[51] Int. Cl.[2] ..... B27F 7/02

[58] Field of Search..... 227/100, 111, 48

[56] References Cited

UNITED STATES PATENTS

| | | | |
|---|---|---|---|
| 463,106 | 11/1891 | Dees | 227/111 |
| 3,298,584 | 1/1967 | Miller | 227/111 |

*Primary Examiner*—Granville Y. Custer, Jr.

*Attorney, Agent, or Firm*—Reilly and Hancock

[57] ABSTRACT

A movable framework retains an edge guide apparatus preferably in the form of a slanted rotary member or members, for determining a reference position relative to the edge of a previous tier of roofing shingles. The framework has a chute attached thereto for directing shingles into position with a second guide edge attached to the framework to determine the correct stop position of the shingles relative to the rotary guide. A plurality of fastening devices are pivotally attached to the framework in correct spacing and an actuating handle arranged to pivot these fastening devices in tandem into their proper positions relative to a shingle contained within the chute. The basic framework can accommodate a storage rack for shingles to be used and can be wheel-mounted for ease of movement. Further, the apparatus can be easily arranged to be self-contained by including a storage tank for operating pneumatically actuated fastening devices.

8 Claims, 5 Drawing Figures

SHINGLE LAYING MACHINE AND PROCESS

BACKGROUND OF THE INVENTION

This invention relates to apparatus and processes for accurately positioning relatively flat materials on a surface and fastening those materials to the surface once positioned. More particularly, the present invention relates to apparatus for accurately locating flat stock such as shingles or the like on a surface such as a roof and for attaching this flat stock to the surface. The present invention is particularly useful for proper alignment of roofing shingles and attaching those shingles to a roof surface.

The attachment of flat stock material such as roofing shingles, hardwood floors and the like has been and continues to be a predominately manual operation. There have been some devices developed particularly for facilitating the placement and attachment of hardwood floors with examples of such apparatus being shown in U.S. Pat. Nos. 3,619,895 and 3,764,053 both by E. T. Thompson. Such devices have found some acceptance for hardwood flooring applications but have not been accepted for roofing shingle attachment purposes because of their size, cost and complexity. Apparatus for aiding in the alignment of roofing shingles using special guides attached to the roof has been suggested in U.S. Pat. No. 3,245,192 by Hilson and the application of waterproof sheeting to roofs has been suggested in U.S. Pat. No. 2,500,583 by Smith. Another arrangement for providing a shingle carrying and positioning cart is shown in U.S. Pat. No. 3,794,327 by Hernandez.

Despite the efforts to develop apparatus to assist the building trade industry in roof shingling, there is a continuing need for a relatively simple, lightweight apparatus which automatically aligns the shingles relative to each other without requiring special guide means attached to the subsurface. Further, there is a continuing need for a device which will not only accurately position and shingles in sequential rows but additionally provide accurate stapling or nailing of the thus positioned shingles to the subsurface. Particularly for residential roofing purposes, the device must be easily portable and adaptable for use on sloping surfaces.

SUMMARY OF THE INVENTION

The present invention is an apparatus and/or process for facilitating the accurate placement and attachment of roofing shingles. More particularly, the apparatus and/or process of the present invention are concerned with a roof shingle placement and attaching device which is of relatively lightweight construction thus facilitating its placement and use on a roof. The device is movable longitudinally along the roofing subsurface and includes an edge-following arrangement such as a pair of slanted rotary wheels and a guiding chute which terminates at a stop bar located at an appropriate distance from the edge-following wheels. A desired number of attaching devices such as staplers can be pivotally attached to the framework at selected spacings and automatically actuated in parallel by a single actuating bar when the shingle to be attached has been placed within the chute. The framework includes a bin arrangement for holding a supply of shingles to be fed into the chute and, by wheel mounting the framework, the entire assembly can be moved longitudinally along a row of shingles so as to significantly increase the speed of shingle application to a roof.

An object of this invention is to provide an apparatus and process for accurately positioning flat stock material relative to a surface and attaching such material to that surface.

Another object of this invention is to provide an apparatus particularly well suited for correctly positioning and attaching roofing shingles on a roofing surface.

A further object of this invention is to provide an apparatus for aligning a roofing shingle in correct position relative to a preceding row of shingles and to appropriately fasten the aligned shingle in that position.

A still further object of this invention is to provide a relatively lightweight, low cost apparatus particularly useful for significantly increasing the speed of shingling of a roof.

The foregoing and other objects, features, advantages and applications will be more apparent in view of the following description of an exemplary preferred embodiment.

DETAILED DESCRIPTION OF THE PREFERRED EMBODIMENT

Figure 1:
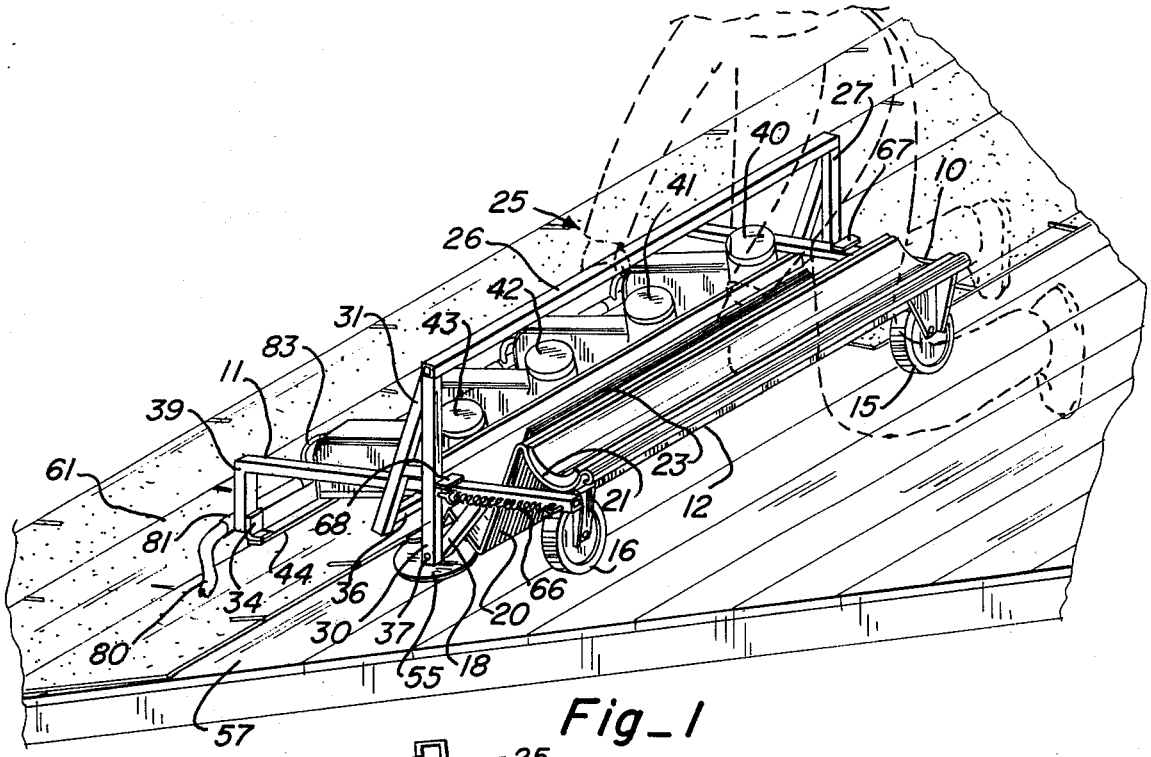
FIG. 1 is a perspective view of the preferred embodiment of this invention illustrating its typical use in a shingling application on a sloped roof.

In the exemplary preferred embodiment, tubular side frames 10 and 11 are attached to a front frame member 12 which further has casters 15 and 16 attached thereto. A pair of side arms 17 and 18 are rigidly attached in downward extending position to side frames 10 and 11 respectively, side arm 17 being visible in FIG. 2. A cross frame 19 is attached between side arms 17 and 18.

A tray 20 is attached at its channel portion 21 to front frame 12 and the other edge of tray 20 is attached to cross frame member 19. Thus tray 20 is arranged to provide storage for shingles 23 to be used in conjunction with the device. Further, cross bar 44 depends from side frames 10 and 11 by L-brackets 33 and 34 which are attached to members 38 and 39. An additional cross beam 45 is rigidly attached between side frames 10 and 11 so that arcuate guides 46–48 are held in position between cross beams 44 and 45 in interleaved relation with respect to staplers 40–43 as can best be seen in FIG. 4 along with FIGS. 2 and 5.

A stapler beam actuator assembly 25 is composed of cross bar 26 which has A-shaped actuator arms attached thereto. More particularly, the right side of lever actuator 25 (note FIG. 2) includes a lever arm 27, actuator arm 28 and cross brace 29 formed as a rigid A-shaped configuration outside of side frame 10 with this entire arrangement being pivotally attached to collar assembly 51 at pin 35. Collar assembly 51 is rigidly attached across the lower end of side arm 17 so as to retain the mounting axle for slanted wheel 54 in offset relation as will be discussed later. A similar A-frame arrangement composed of arms 30 and 31 with cross brace 32 (note FIGS. 1 and 5) are pivotally attached outside of side frame 11 on the other side. The lower ends of arms 28 and 31 are attached to cross beam 36 to which are attached staplers 40–43. Staplers 40–43 are pivotally supported by cross beam 36 and actuator assembly 25 around pins 35 and 37.

Figure 2:
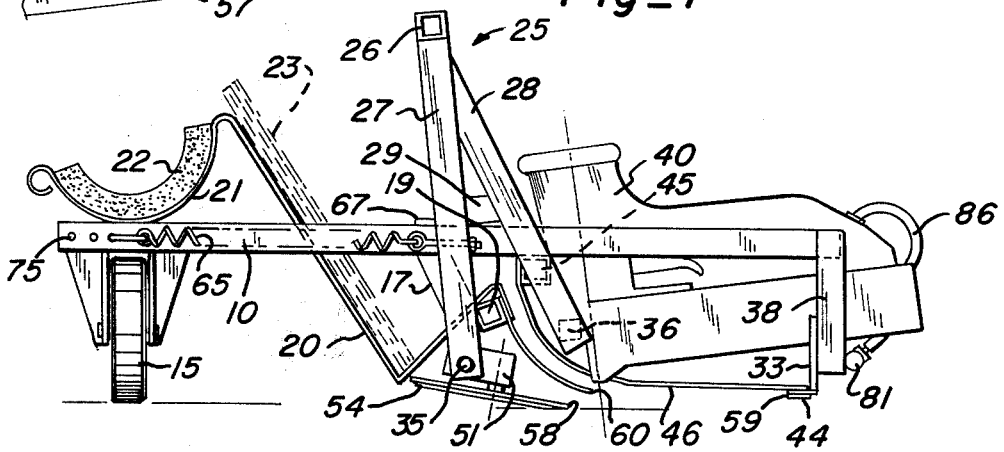
FIG. 2 is an end view of the FIG. 1 apparatus.
Figure 3:
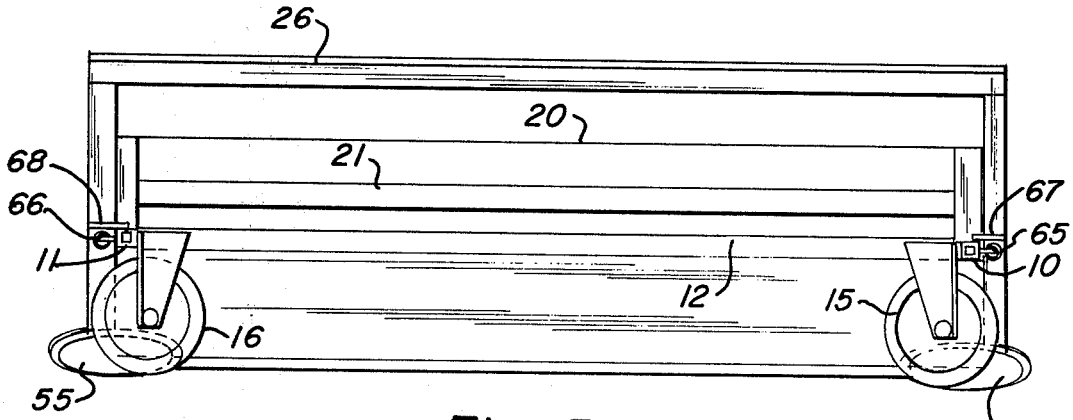
FIG. 3 is a front view.
Figure 5:
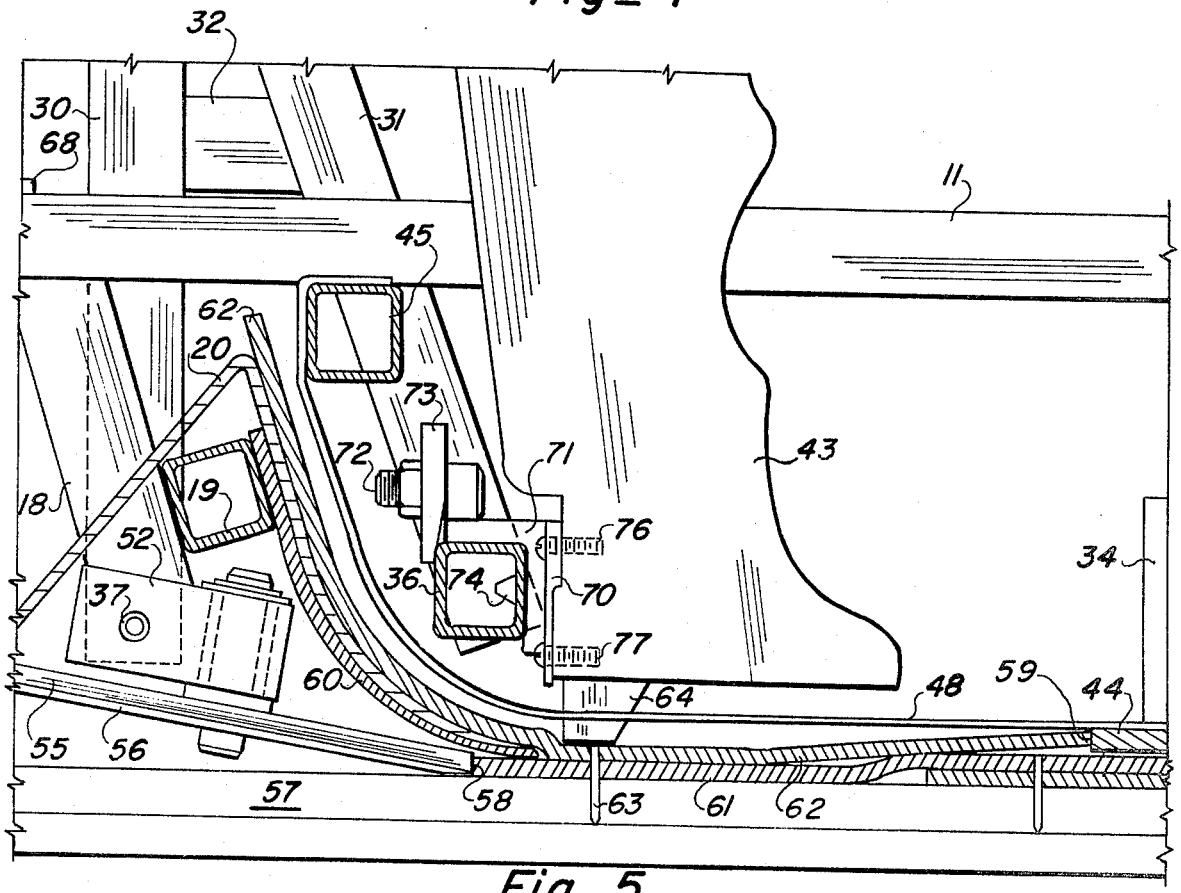
FIG. 5 is a partial side view of the preferred embodiment taken along lines 5—5 of FIG. 4 showing the interrelationship of the parts at the point that a shingle is being attached to a subflooring.

Affixed to the lower extremity of side arms 17 and 18 are a pair of bearing blocks or mounting collars 51 and 52 which are most readily seen in FIGS. 2 and 5, respectively. Collars 51 and 52 provide rotary offset mounting in slanted relation to the surface for wheels 54 and 55 respectively. As can more clearly be seen in FIG. 5, slant wheels 54 and 55 have beveled edges 56 so as to more nearly conform to the surface 57 and maintain a relatively perpendicular interface 58. Accordingly, a relatively fixed distance is maintained between this peripheral interface 58 and the inner guide edge 59 of rear cross beam 44. It will be readily apparent to those having normal skill in the art that other arrangements can be used which effect equivalent guiding and support functions between interface 58 and edge 59. For example, interface 58 could obviously be established by a bar similar to beam 44 but attached to the framework such as at arms 17 and 18 with movable supports being provided by additional vertically oriented roller casters similar to 15 and 16 attached to the framework in proximity to the bar and arranged to engage subsurface 57.

Curved guide plate 60 which actually could have been formed as a continuation of tray 20 is attached to cross beam 19 and extends in a downward arcing arrangement so as to terminate just above the edge of wheels 54 and 55 as best seen in FIG. 5.

In use as is illustrated in FIGS. 1 and 5, the wheels 54 and 55 are positioned so that their peripheral tangential edges such as 58 are in abutting relation to underlying shingle 61. One of the shingles 62 is selected from supply 23 and fed between arcuate guide 60 and curved guides 46–48 until the edge thereof is against the inner surface 59 of rear guide 44. This selected shingle 62 is then in position for attachment to sheathing or subsurface 57. At this point, the operator shown in phantom in FIG. 1 pushes outwardly on cross beam 26 of stapler beam lever arm assembly 25. Assembly 25 pivots so as to force the stapler points for staplers 40–43 down against the upper surface of shingle 62. Pneumatically energized mechanical staplers when used for fastening devices 40–43 as illustrated are of the type which are triggered by pressure between the safety yokes thereof and the surface 57 so that they are fired in tandem. The staples released by fasteners 40–43 such as is shown at 63 are thence driven through shingle 62 and 61 into sheathing 57 retaining it in place. After actuator lever arm 26 has been released, springs 65 and 66 which are attached to side frames 10 and 11, respectively, bias lever assembly 25 backward against stops 67 and 68 so that the staplers 40–43 are pivoted back in an upward direction from between the guides 46–48 thereby removing them from the shingle positioning channel defined between guide plate 60 and guides 46–48.

Figure 4:
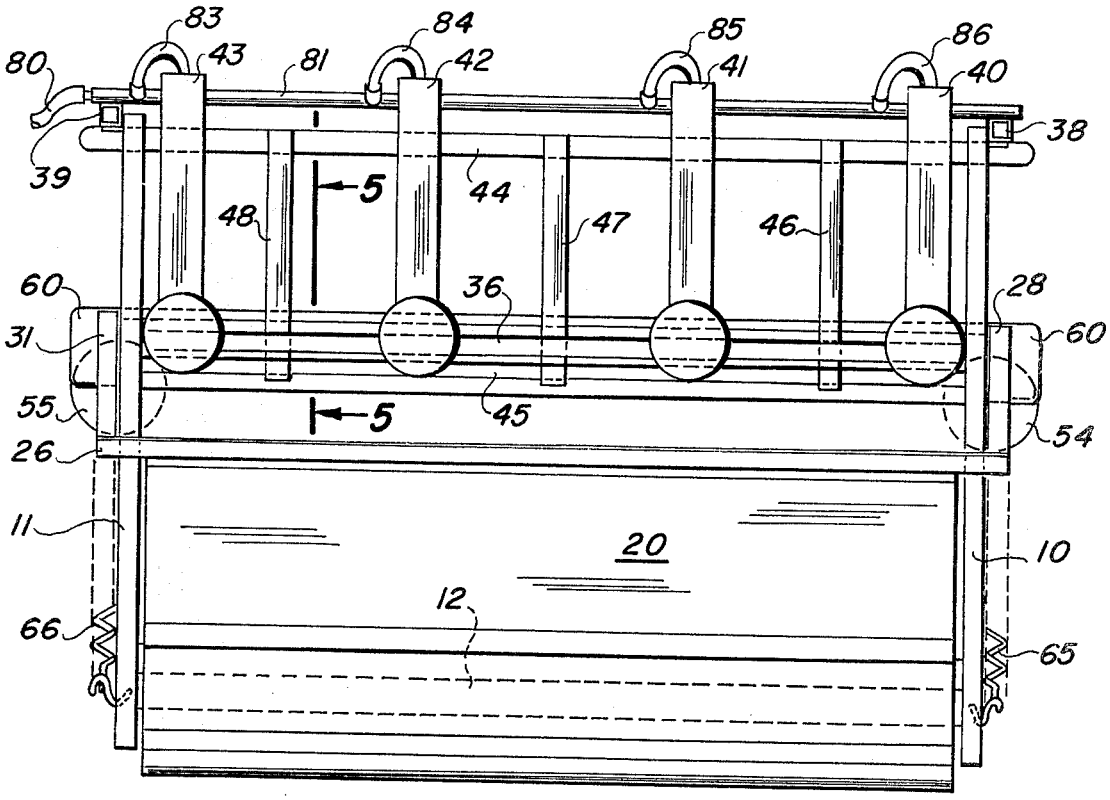
FIG. 4 is a top view.

Although staplers 40–43 are illustrated as mechanically actuated pneumatic devices in FIGS. 1, 2 and 4, any state-of-the-art device can be used such as devices which employ electric power, etc. Pneumatic staplers enjoy the further advantage of being potentially actuable in tandem by a single triggering mechanism (not shown). Further, FIG. 5 illustrates one arrangement for conveniently and rapidly attaching any of a variety of staplers to the basic framework. More particularly, an L-shaped member 71 includes two opposite side shoulders such as 70 which are attached to the face of stapler 43 via screws 76 and 77. The upper surface of L-bracket 71 has bolt 72 attached thereto for releasably retaining plate 73 in clamping relation to cross beam 36 so as to retain the stapler in place in a stable position. Note that the rear portion of stapler 43 is broken away in FIG. 5.

As more clearly shown in FIGS. 1 and 2, the channel 21 of tray 20 is preferably filled with a padding material 22. As seen in FIG. 1, this permits the operator to kneel on padding 22 while positioning and operating the mechanism and to move the device longitudinally across the roof while thus kneeling on the apparatus. Further, a series of holes such as 75 along each side frame 10 and 11 permits adjustment of the tension on springs 65 and 66 as desired. Note further that, in the event that pneumatic staplers are to be used, a compressed air tank and/or portable compressor can be easily mounted to be carried by the apparatus. For example, the tank could be attached between side frames 10 and 11 below tray 20 so that the entire apparatus can be self-contained. The tank can then be connected via hose 80 into air supply header 81 which distributes the compressed air via feeder lines 83–86 to existing pneumatic connections on the staplers 40–43. Of course supply hose 80 can likewise be connected to a separate remote compressed air source if desired. Further, the actuation of the staplers can be controlled by a separate manual switch (not shown) triggered by pivoting of assembly 25 or can be actuated by a predetermined amount of pressure on the face of the stapler as is well known. However, in a typical operation as shown using the S-170 stapler of the Fastener Corporation for staplers 40–43, the triggers are locked in the fire position and the device actually fired by pressure on the safety yoke 64 against the shingles with about ⅜ inch travel of yoke 64 being required for firing.

The knee rest formed by 21 and 22 can include horizontal and/or vertical adjustment if desired and the device can be adapted for accommodating shake shingle application with modifications. For instance, the disclosed apparatus can be modified for shake shingles by arranging the slanted wheels 54 and 55 to follow the lower edge of the previous row with the machine appropriately arranged to operate from this lower level. However, a significant advantage of the preferred embodiment as shown for installing flexible shingles is that it does not rest or slide upon the previously attached shingles thereby avoiding any marring or scoring thereof. The device is effectively bidirectional as far as shingle installation is concerned meaning that it can be employed in one direction across a first row of shingles and simply operated in the opposite direction for the next row.

In summary, the preferred embodiment as described is a relatively easy to manufacture device which avoids the complexity of previous flat stock attaching machinery. The weight of the device is acceptable for use in such applications as residential roofing and the structure is sufficiently strong so as to accommodate the intended use with a relatively low center of gravity increasing its acceptability for sloped roof shingling. The device is free of any requirements for synchronizing the shingle feeding and is bidirectional in usage. Further, it can easily accommodate any of a variety of well known staplers and can accommodate different numbers of such staplers. That is, although four staplers are shown in the preferred embodiment, it will be recognized that the apparatus can be arranged to accept a greater number of staplers with essentially the same structure as shown. Mounting holes are included in the cross beam 36 for receiving alignment pin 74 which extends from L-bracket 71 (note FIG. 5). Additional alignment holes can be arranged along beam 36 as needed. For example, additional holes in beam 36 can be placed for retaining two appropriately spaced staplers between guides 46 and 47 as well as two other staplers between guides 47 and 48 so that six staples can be concurrently driven into the shingles.

Although the present invention has been described with particularity relative to the foregoing exemplary embodiment, various other changes, additions, modifications and applications will be apparent to those having normal skill in the art without departing from the spirit of this invention.

What is claimed is:

1. Apparatus for accurately positioning shingles or the like relative to a reference edge on a subsurface such as the edge of a previously attached shingle and for attaching the positioned shingles to the subsurface comprising:

a tubular mounting framework, at least two guide wheels, means rotatably attaching said guide wheels to said framework with the axis thereof offset from the perpendicular relative to the subsurface by a relatively small acute angle so that the peripheral edges of said wheels will tangentially abut the reference edge, a flat bar attached to said framework for positioning an elongated edge thereof a predetermined distance from and in facing relation to said peripheral edges of said wheels, chute means attached to said framework for guiding a shingle in a generally flat orientation over said peripheral edges of said wheels into abutting relation to said flat bar elongated edge, a plurality of fastener devices, and means pivotally mounting said fastener devices to said framework for selectably facing a shingle in said chute towards the subsurface and for fastening the shingle to the subsurface.

2. Apparatus in accordance with claim 1 wherein said wheels each have a level surface thereon at the peripheral edges thereof for substantially flat engagement with the subsurface.

3. Apparatus in accordance with claim 1 wherein said framework includes a front, a rear and two side frames with said flat bar being attached to said rear frame and said side frame having said chute and said guide wheels mounted therebetween, said pivotal mounting means including a pair of generally A-shaped assemblies interconnected between the apexes thereof with a cross bar, said assemblies having one side arm pivotally attached to respective said side frames and the other side arm attached to said plurality of fastener devices.

4. Apparatus in accordance with claim 3 which further includes means for applying a biasing force between said assemblies and said framework for retaining said fastener devices pivoted away from said chute means in the absence of application of a counter force to said pivotal mounting means.

5. Apparatus in accordance with claim 3 which further includes supporting means attached to said front frame for accommodating movement of said framework in a direction parallel to the reference edge.

6. Apparatus in accordance with claim 3 which further includes tray means mounted between said side frames for storing a plurality of shingles in proximity to the feed opening of said chute means.

7. Apparatus for accurately positioning roofing shingles or the like relative to a reference edge on a subsurface such as the edge of a previously attached shingle and for attaching the thus positioned shingle to the subsurface comprising:

a tubular base frame including front, rear and two side members arranged in a generally rectangular configuration, a sheet of material having the leading edge attached between said side members, said sheet being formed to define a storage bin in proximity to said leading edge and a downwardly oriented arcuate surface in proximity to said trailing edge, a pair of guide wheels rotatably attached to respective said side members so that the peripheral edges thereof are substantially perpendicular to the subsurface for tangentially aligning with the reference edge, said guide wheels each having a level surface for substantially flat engagement of the subsurface when said peripheral edges are in tangential engagement with the subsurface reference edge, a flat bar suspended below said rear member and having an elongated edge in opposed facing relation to and a predetermined distance from said tangential peripheral edges of said guide wheels, a plurality of curved guide fingers each having an at least partially arcuate flat surface, means attaching said guide fingers between said side members and said rear member for forming a downwardly projecting chute in conjunction with said arcuate surface of said sheet, the chute thus formed having a generally flat exit area commencing over the subsurface beyond said guide wheel peripheral edges and terminating at said flat bar elongated edge, a plurality of selectably actuable fastener implanting devices, means mounting said fastener devices to said base frame for tandem downward pivotal movement thereof in interleaved relation with said guide fingers between said flat bar elongated edge and the end of said arcuate sheet surface, means for pivotally biasing said fastener devices into a position above said guide fingers, and means attached to said front member for providing movable support thereof in a direction parallel to said flat bar elongated edge, whereby orientation of the tangential edges of said guide wheels in abutting relation with the subsurface reference edge, introduction of a shingle in said chute so as to abut said flat bar elongated surface and application of a force to said fastener device mounting means in opposition to said biasing means and actuation of said fastener implanting devices will result in attachment of the shingle to the subsurface in an accurate position with respect to the subsurface reference edge.

8. Apparatus in accordance with claim 7 wherein said fastener devices mounting means includes a pair of A-shaped lever assemblies each having the end of one arm pivotally attached to a respective said side frame, a first cross beam interconnecting said assemblies above the plane of said base frame, and a second cross beam connected between the ends of the other arms of said lever assemblies with said fastener devices being attached in an array across said second cross beam, whereby application of a force to said first cross beam in a direction opposite said biasing means force will effect pivoting of said fastener devices into engagement with the surface of a shingle in said chute so that fasteners can be implanted therein by said devices.

* * * * *